United States Patent [19]

Kelly

[11] 4,270,898

[45] Jun. 2, 1981

[54] CONTROL METHOD FOR A RECLAMATION FURNACE

[75] Inventor: Stephen B. Kelly, Dallas, Tex.

[73] Assignee: Pollution Control Products Co., Dallas, Tex.

[21] Appl. No.: 57,728

[22] Filed: Jul. 16, 1979

[51] Int. Cl.[3] ..... F27D 7/00; F27D 9/00

[52] U.S. Cl. ..... 432/19; 432/4; 432/37; 432/38; 432/48; 432/72

[58] Field of Search ..... 432/4, 19, 37, 38, 48, 432/72; 134/1

[56] References Cited

U.S. PATENT DOCUMENTS

| | | | |
|---|---|---|---|
| 3,306,237 | 2/1967 | Ransom, Jr. | 432/72 |
| 3,705,711 | 12/1972 | Seelandt et al. | 432/72 |

*Primary Examiner*—John J. Camby

*Attorney, Agent, or Firm*—Arthur M. Sloan

[57] ABSTRACT

A method for preventing fires and explosions and thus controlling excess temperature within a burn-off or reclamation furnace including a water injection nozzle within the furnace, an automatic valve assembly connected to a source of water under pressure to turn the water on and off, an input burner to heat contaminate materials, an afterburner to burn volatile gases given off by the contaminate materials as they are heated, a temperature sensor located in the discharge from the afterburner to actuate the automatic valve assembly open and closed responsive to the temperature of the discharge, the temperature of the discharge depending on the rate of emission of volatile gases from the contaminate material so that if a high emission rate causes a predetermined temperature to be exceeded the valve assembly opens and the water injection nozzle sprays water on the contaminate materials to cool them and decrease the emission rate until the valve assembly closes.

4 Claims, 2 Drawing Figures

CONTROL METHOD FOR A RECLAMATION FURNACE

This invention relates to an improved method of preventing explosions, and fires within ovens, or furnaces, used to reclaim metal parts contaminated with combustible substances by burning off the combustible substances from the metal parts. The method of the invention provides a controlled rate of burn in a reclamation furnace to burn off a thermally degradeable coating while leaving the parent metal unaffected.

Many parts used in both home and industry are rebuilt and reused. Some of these parts are made of metal and have non-metallic portions which must be removed to allow the metal portion to be rebuilt into a reusable part. Electric motor stators and armatures, transformers, automotive alternators, generators, starters, brake shoes, engine blocks, engine heads, steel drums, painted parts, lacquered parts, and coated parts are some examples of parts that can be reused if the non-metallic portion is removed and then replaced with new insulation, varnish, paint or whatever non-metallic material is required to make the part acceptable for use again.

Prior art furnaces are equipped with two temperature sensing devices or thermocouples located in the furnace compartment with one of the temperature sensing devices to control the heat input burner and to keep the furnace at the desired reclamation temperature, normally 700 degrees to 800 degrees Fahrenheit, and the second temperature sensing device to detect a fire and set a few degrees higher than the heat input burner controller to turn on an extinguishing system after ignition has occurred. Heating of the parts to temperatures of 700 degrees to 800 degrees Fahrenheit in an enclosure with limited air inlet will char or degrade all known combustible contaminants on such parts without ignition if the percentage of combustibles is small, i.e., 1 or 2 per cent by weight of the part, or if the total amount of combustibles is kept small by limiting the quantity of parts; however, it is difficult to judge how much combustible material may be on a given load of parts and the tendency is to overload the equipment so that ignition of the combustible material often takes place and the explosions and/or fires which result frequently damage the metal parts by warping or melting and sometimes damage the furmace or oven or other equipment used to burn the parts. Ignition of the gases coming off the parts quite often occurs with a puff or small explosion before actual flaming. The second temperature sensing device of prior art furnaces, as noted, is set to sense a fire and attempts to control normally uncontrollable fires by sensing the high temperatures generated by the fire and then spraying water or some extinguishing chemical on the fire to put it out; however, the explosive nature of the ignition and the rapidity of the resulting fire and temperature rise make such prior art systems an inadequate answer to safely burning such parts.

The basic reason that explosion and fire occur in prior art furnaces is that the emission of volatile gases from the parts becomes greater than the equipment can handle and the enclosure holding the parts becomes filled with an explosive mixture of air and volatiles. The inherent problem of prior art devices is that ignition has to occur in prior art devices before the second temperature sensor can respond and turn on the extinguishing system. Although the parts are giving off more volatiles than can be handled by an afterburner, i.e., a separate compartment with a heat source to burn the volatiles, just prior to ignition, the condition can not be sensed by prior art devices until the explosion or fire has already occurred.

The problems of prior art systems have been eliminated by the method or system of the present invention in which the second temperature sensor is located in the exhaust stack, smoke stack, or vent from an afterburner. In the system of the present invention the reclaimable object or part is placed inside the furnace and a heat input burner is activated to bring the part to the desired temperature. As the temperature of the part starts to rise, the part gives off combustible smoke and gases. These volatiles are drawn into an afterburner where they are ignited by a second burner flame through which the smoke and gases must pass before exiting into the afterburner exhaust stack or vent. This type of controlled pyrolysis furnace depends on the afterburner to burn and exhaust the volatile material being liberated so that these volatiles will not have a chance to accumulate in the furnace and cause an explosion and/or fire.

The system of the present invention detects an increase in volatile release not by measuring the volume of volatiles but indirectly by sensing an increase in afterburner temperature by measuring the temperature in the afterburner exhaust stack or vent. The outlet or vent temperature of the afterburner with no volatile material being processed can be easily determined and may run from 1200 degrees to 1400 degrees Fahrenheit. When parts with much combustible material are heated, the volatiles given off burn in the afterburner and raise its outlet temperature. The more volatiles entering the afterburner, the higher the temperature produced. In our studies the temperature ranged from 1300 degrees Fahrenheit for a few volatiles to 1700 degrees Fahrenheit for a full afterburner. If 1700 degrees Fahrenheit was exceeded in the afterburner, ignition usually occurred within one to two minutes. Since the difference between no volatiles and too many volatiles is approximately a 400 degree Fahrenheit temperature range, it is possible to sense a potential fire hazard before the 1700 degree Fahrenheit ignition temperature is reached. A temperature sensor located in the afterburner exhaust can measure the afterburner temperature and if it exceeds a preset point, the sensor will actuate a valve to open and allow water or other cooling or extinguishing medium to enter the parts enclosure and cool the parts to diminish the rate of volatile emissions. This reduced emission rate will indicate itself by an almost immediate reduction in afterburner temperature. When the temperature in the afterburner outlet drops below the preset point, the valve is closed, and the extinguishing system stops, and the parts continue to be processed. The furnace compartment temperature will also fall slightly, enough to turn on the heat input burner to raise the furnace compartment back to a preset level. This increases the volatile emission rate which in turn raises the afterburner temperature and initiates the extinguishing system once again. This on-again, off-again type of control gives the ability to finish the burning cycle in the shortest time without the explosion and fire problems experienced in prior art systems.

Accordingly, it is an object of the subject invention to provide an improved fire and explosion control method for a reclamation furnace.

Another object of the subject invention is to provide an improved fire and explosion control method for a reclamation furnace to sense a fire situation before it occurs and to keep the fire from happening by instituting a timely extinguishing system.

A further object of the subject invention is to provide an improved fire and explosion control method for a reclamation furnace using water spray to control the rate of burn.

Yet another object of the subject invention is to provide an improved fire and explosion control method for a burn-off furnace to indicate a potential fire and/or explosion before the occurrence by reading the afterburner smoke-stack temperature and letting this temperature control the on-off cycle of an extinguishing system.

Still other and further objects of this invention will become apparent to one skilled in the art upon reference to the following specification, the accompanying drawings, and the claims.

Figure 1:
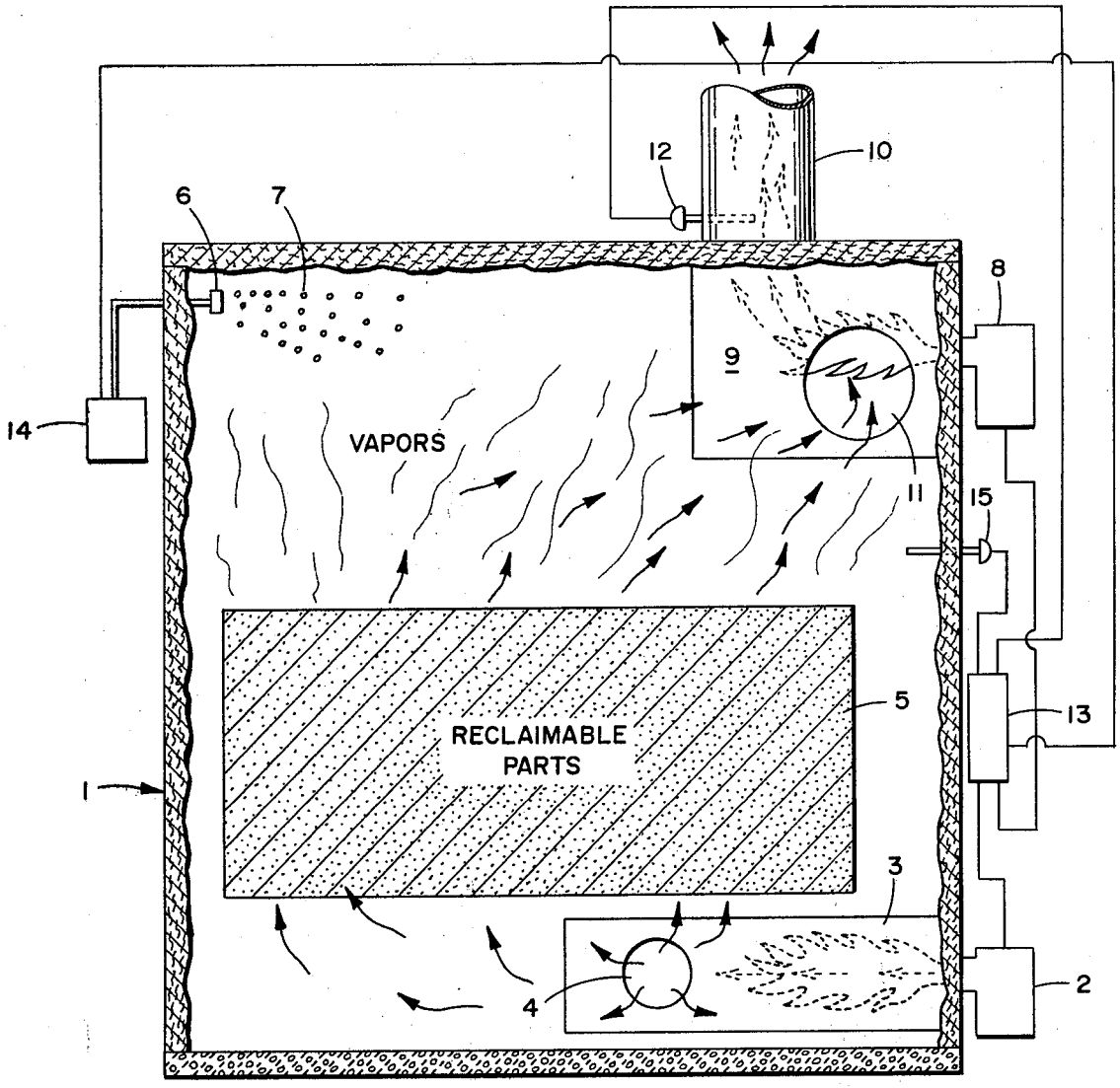
FIG. 1 is a diagrammatic view of a burn-off furnace utilizing the temperature control method of the subject invention.
Figure 2:
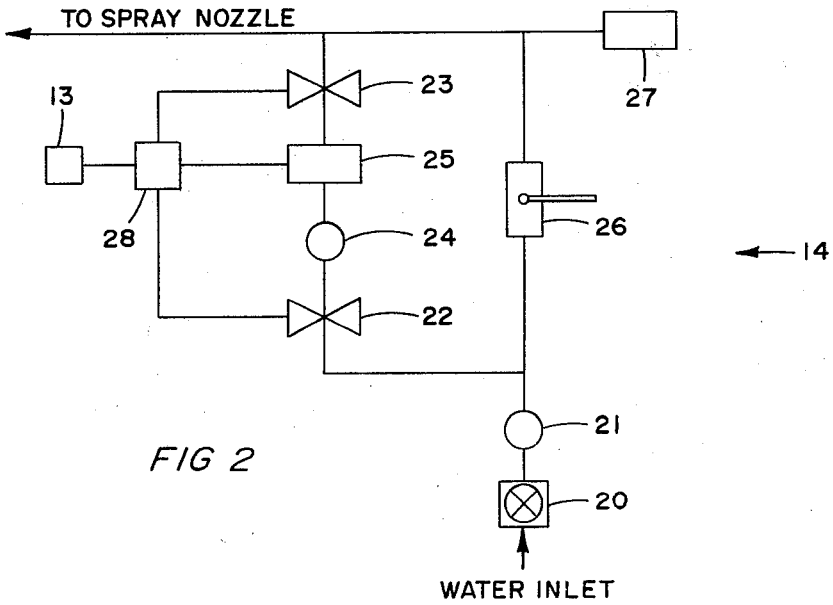
FIG. 2 is a schematic view of a valve assembly in accordance with the subject invention.

Referring to the drawings, reclamation or burn-off furnace 1 is provided with lower heat input burner 2 and combustion chamber 3. Combustion chamber 3 has inlet hole 4 through which heated air is released into furnace 1 and reclaimable parts 5. Water spray nozzle 6 is situated in the upper corner of furnace 1 and is angled to spray a fine mist of water spray 7 or other suitable extinguishing fluid on to reclaimable parts 5 when activated. Upper burner 8 sends flame into afterburner chamber 9. Vent-stack or smoke-stack 10 which is connected to afterburner chamber 9 exhausts gases into the atmosphere or other suitable exhaust receptacle. Volatiles given off by reclaimable parts 5 as they are heated enter afterburner chamber 9 smoke hole 11 where the afterburner flame ignites the volatiles as they flow by natural convection to vent-stack 10 and past thermocouple or sensing device 12 which sends generated signals to control box 13 and when a preset temperature is exceeded water spray nozzle 6 is activated.

Spray nozzle 6 is connected to valve assembly 14 and to control box 13. Water enters gate valve 20 from a source of water under pressure and flows through strainer 21 before normally closed solenoid valve 22 stops the flow. When control box 13 is activated, normally open solenoid valve 23 closes and normally closed valve 22 opens sending water through pressure gauge 24 and pressure switch 25. When enough water pressure is present to close pressure switch 25 a signal is sent to control box 13 which initiates normal start up of furnace 1 by lighting heat input burner 2 and afterburner 8. Furnace 1 will increase internal temperature until thermocouple or sensor 15 sends a signal to control box 13 that temperature set point has been reached. Temperature set point of 750 degrees Fahrenheit may be used for sensor 15. When this occurs heat input burner 2 will shut off but will continue to cycle on-off to keep the furnace 1 temperature at a level indicated by control box 13. The system is now in standby mode. If sensor 12 generates a signal to control box 13 indicating higher than set point temperature reading, then normally open valve 23 de-energizes and opens which sends water to spray nozzle 6 which issues water spray 7 into furnace 1 and on to reclaimable parts 5. If electrical power is interrupted and water spray 7 needs to be activated, then manual by-pass valve 26 can be used to release water to spray nozzle 6. A temperature set point of 1600 degrees Fahrenheit or other suitable temperature set point may be used for sensor 12.

A mechanical pressure relief is indicated at 27. Junction box 28 connects control box 13 to normally open electric solenoid valve 23, pressure switch 25, and normally closed solenoid valve 22.

What I claim as my invention and desire to secure by Letters Patent of the United States is:

1. In a reclamation furnace having a lower heat input burner connected to a combustion chamber, structure within the furnace above the combustion chamber for supporting reclaimable parts, an upper burner connected to an afterburner chamber having a vent-stack, said upper burner and afterburner chamber together comprising an afterburner, the afterburner chamber being located within the furance above the structure for supporting reclaimable parts, a method for preventing fires and explosions, including heating contaminate materials with the input burner and burning volatile gases given off by the contaminate materials in the afterburner while sensing the temperature in the vent-stack with the temperature sensing means actuating a valve assembly connected to a source of water, open and closed, responsive to the temperature of the discharge through the vent-stack; so that if a high volatile emission rate causes a predetermined temperature to be exceeded, the valve assembly opens, and actuates a spray nozzle which sprays water on the reclaimable parts to cool them and decrease the volatile emission rate until the valve assembly closes, and another temperature sensing means controls the heat input burner on and off through control means responsive to a preset temperature.

2. A method for preventing fires and explosions within a burn-off furnace, including heating contaminate materials with an input burner and burning volatile gases given off by the contaminate materials in an afterburner while sensing the temperature in the afterburner vent-stack with the temperature sensing means actuating a valve assembly, connected to a source of water, open and closed responsive to the temperature of the discharge through the vent-stack so that if a high volatile emission rate causes a predetermined temperature to be exceeded, the valve assembly opens and actuates a spray nozzle to spray water on the reclaimable parts to cool them and decrease the volatile emission rate until the valve assembly closes.

3. A method for preventing fires and explosions within a burn-off furnace, including heating contaminate materials with an input burner and burning volatile gases given off by the contaminate materials in an afterburner while sensing the temperature in the afterburner vent-stack with the temperature sensing means actuating a valve assembly, connected to a source of extinguishing fluid, open and closed responsive to the temperature of the discharge through the vent-stack so that if a high volatile emission rate causes a predetermined temperature to be exceeded, the valve assembly opens, and actuates a spray nozzle to spray extinguishing fluid on the reclaimable parts to cool them and decrease the volatile emission rate until the valve assembly closes.

4. A method for preventing fires and explosions, including burning volatile gases with an afterburner having a vent-stack while sensing the temperature in the afterburner vent-stack with the temperature sensing means actuating valve means, connected to a source of extinguishing fluid, open and closed responsive to the temperature in the afterburner vent-stack so that if a high volatile emission rate causes a predetermined temperaure to be exceeded, the valve means opens and actuates spray means which sprays extinguishing fluid on the source of volatile gases to cool it and decrease the emission rate until the valve means closes.

* * * * *